US007617860B2

(12) United States Patent
Spiess

(10) Patent No.: US 7,617,860 B2
(45) Date of Patent: Nov. 17, 2009

(54) ELEVATOR DOOR SYSTEM

(75) Inventor: Peter A. Spiess, Meggen (CH)

(73) Assignee: Inventio AG, Hergiswil NW (CH)

( * ) Notice: Subject to any disclaimer, the term of this patent is extended or adjusted under 35 U.S.C. 154(b) by 105 days.

(21) Appl. No.: 11/550,985

(22) Filed: Oct. 19, 2006

(65) Prior Publication Data

US 2007/0199771 A1 Aug. 30, 2007

(30) Foreign Application Priority Data

Oct. 21, 2005 (EP) ..... 05109845

(51) Int. Cl.
*E06B 9/08* (2006.01)

(52) U.S. Cl. ..... 160/133; 160/189; 160/193; 160/310

(58) Field of Classification Search ..... 160/133, 160/188, 189, 190, 193, 310; 187/315, 327, 187/329, 333, 334, 340, 341
See application file for complete search history.

(56) References Cited

U.S. PATENT DOCUMENTS

| | | | | | |
|---|---|---|---|---|---|
| 490,448 | A | * | 1/1893 | Lugrin | 160/120 |
| 778,228 | A | * | 12/1904 | Dodge et al. | 160/239 |
| 1,621,717 | A | * | 3/1927 | Grant et al. | 160/133 |
| 1,936,251 | A | * | 11/1933 | McCullough | 280/749 |
| 2,320,052 | A | * | 5/1943 | Rodriguez | 160/231.2 |
| 2,404,257 | A | * | 7/1946 | Thomas | 160/133 |
| 2,610,681 | A | * | 9/1952 | Schaap | 160/230 |
| 2,934,139 | A | * | 4/1960 | Wardlaw et al. | 160/26 |
| 3,019,450 | A | * | 2/1962 | Karasiewicz | 4/502 |
| 3,050,743 | A | * | 8/1962 | Lamb | 4/502 |
| 3,451,463 | A | * | 6/1969 | Lyman | 160/23.1 |
| 3,465,805 | A | * | 9/1969 | Lyman | 160/23.1 |
| 3,504,728 | A | * | 4/1970 | Wardlaw | 160/26 |
| 3,680,622 | A | * | 8/1972 | Lester, Jr. | 160/25 |
| 3,833,045 | A | * | 9/1974 | Sivin | 160/133 |
| 4,126,173 | A | * | 11/1978 | Theuerkauff | 160/229.1 |
| 4,934,437 | A | * | 6/1990 | Kraeutler | 160/84.02 |
| 5,332,021 | A | * | 7/1994 | Todd et al. | 160/133 |

(Continued)

FOREIGN PATENT DOCUMENTS

| | | |
|---|---|---|
| DE | 88 13 821 U1 | 3/1990 |

(Continued)

*Primary Examiner*—Katherine W Mitchell
*Assistant Examiner*—Jaime F Cardenas-Garcia
(74) *Attorney, Agent, or Firm*—Fraser Clemens Martin & Miller LLC; William J. Clemens

(57) ABSTRACT

An elevator door system includes a motor rotating a vertical reel, and an elevator door. The door can be formed of a plurality of vertically aligned rigid panels or can be a sheet of material which is rigid or reinforced in the vertical direction or can have any other appropriate form making it suitable for being wound upon and unwound from the reel. The door is mounted to a flexible force transmission member provided along an entire width of the door and interconnected to the reel. Accordingly, the forces generated by the motor for opening and closing the door are substantially transmitted through the transmission member rather than being imparted onto the door itself. Hence, in use the strain on the door is greatly reduced and therefore the quantity of material used for the door and consequently its cost and mass can be reduced without deteriorating performance.

4 Claims, 5 Drawing Sheets

U.S. PATENT DOCUMENTS

| | | | | |
|---|---|---|---|---|
| 5,404,926 | A * | 4/1995 | Ojima et al. | 160/280 |
| 5,752,557 | A * | 5/1998 | Crider et al. | 160/121.1 |
| 5,915,447 | A * | 6/1999 | Lassen | 160/265 |
| 6,142,260 | A * | 11/2000 | Shin | 187/333 |
| 6,345,419 | B1 | 2/2002 | Traktovenko | |
| 6,352,097 | B1 * | 3/2002 | Kern et al. | 160/197 |
| 6,431,250 | B2 * | 8/2002 | Mullet et al. | 160/273.1 |
| 6,435,254 | B1 * | 8/2002 | Todd et al. | 160/309 |
| 6,484,368 | B1 | 11/2002 | Rivera et al. | |
| 6,871,686 | B2 * | 3/2005 | Eshpar | 160/231.1 |
| 2002/0046423 | A1 * | 4/2002 | Vilsmeier | 5/11 |
| 2004/0206462 | A1 | 10/2004 | Fitzgerald et al. | |
| 2005/0051283 | A1 * | 3/2005 | Chatellard et al. | 160/265 |
| 2005/0252623 | A1 * | 11/2005 | McTavish et al. | 160/310 |
| 2006/0037718 | A1 * | 2/2006 | Coenraets | 160/133 |

FOREIGN PATENT DOCUMENTS

| | | | |
|---|---|---|---|
| DE | 42 27 328 | C1 | 10/1993 |
| DE | 42 25 179 | A1 | 2/1994 |
| EP | 0 033 199 | A1 | 8/1981 |
| FR | 2664324 | A | 7/1990 |
| FR | 2 664 324 | A1 | 1/1992 |
| WO | WO 03/106801 | A1 * | 12/2003 |
| WO | WO 2005/070807 | A2 | 1/2005 |
| WO | WO 2005/070808 | A2 | 1/2005 |
| WO | WO 2005/070808 | A2 | 8/2005 |

* cited by examiner

ELEVATOR DOOR SYSTEM

BACKGROUND OF THE INVENTION

The present invention relates to elevator doors systems and, in particular, to an elevator door system comprising a door that is wound upon a vertical axis during an opening operation.

Such elevator door systems are well known from the prior art and are described, for example, in WO-A2-2005/070807 and WO-A2-2005/070808. Each elevator door is generally formed from a stainless steel sheet or interconnected vertical rigid panels, typically manufactured from a metal. In operation, as the elevator door is opened and closed, the plurality of panels or sheet is wound onto and unwound from a vertical axis in the form of a motorized reel whereby the driving force from the motor is transmitted through the reel and onto the door to provide lateral movement thereof. Hence, not only does the door need sufficient strength to withstand a specific transverse force applied perpendicular to the plane of the door without exceeding the maximum permissible elastic deformation (as defined by regulations, see for example European Norm EN 81-1:1998 §8.6.7), but it must also be capable of withstanding the lateral driving forces transferred to it from the motor.

Furthermore, in the prior art elevator door systems discussed above the wrapping of the door in layers about the vertical axis can give rise to unwanted noise due to contact between the successive layers and continual winding and unwinding of the door about the reel may cause frictional contact between successive layers which may eventually cause damage to the aesthetic appearance of the door.

FR-A-2664324 discloses a shutter system used to open and close a horizontal opening. A motor acts on a roller to feed out the shutter under compression to close the opening. A continuous or discontinuous belt of hook and loop fastening means (Velcro™) is provided at each end of the shutter to ensure that each panel of the shutter is positioned correctly within the guide channels and to reduce friction therebetween. The Velcro™ belts also ensure that the shutter is tightly wrapped around the roller in the fully opened position. As the Velcro™ belts cannot transmit compressive force, the shutter system of FR-A-2664324 suffers from the same disadvantage of the prior art mentioned above in that it must be capable of withstanding the compressive lateral driving forces transferred to it from the motor.

SUMMARY OF THE INVENTION

An objective of the present invention is to substantially reduce, and preferably cancel completely, the lateral driving forces transferred to the door from the motor during operation.

This objective is achieved by an elevator door system comprising a motor, a vertical axis rotatably driven by the motor, and an elevator door which, in operation, is wound upon and unwound from the vertical axis. The door is mounted to a flexible force transmission member that is provided along an entire width of the door and is interconnected to the vertical axis. The flexible force transmission member is capable of transmitting both tensile and compressive force. Accordingly, the forces generated by the motor for opening and closing the door are transmitted through the or each transmission member rather than being imparted onto the door itself as in the prior art door systems. Hence, in use the strain on the door is greatly reduced and therefore the quantity of material used for the door and consequently its cost and mass can be reduced without deteriorating performance.

Preferably, the flexible force transmission member projects horizontally outwards from the door. Accordingly, on opening, as the door is wound upon the vertical axis, the flexible force transmission member prevents direct contact between successive layers of the door thereby reducing noise and damage. Preferably, the force transmission member is sufficiently flexible so as to adapt to the profile of vertical axis as it is wound onto the vertical axis. This ensures a smooth and continuous engagement between the flexible force transmission member and the vertical axis which greatly reduces the generation of noise or vibration. The flexible nature of the force transmission member will also suppress the transmission of any vibration or noise to the door during operation.

Preferably, a first flexible force transmission member is provided at an upper edge of the door and a second flexible force transmission member is provided at a lower edge of the door. In use, the transmission members may be concealed from passengers within upper and lower guide channels, thereby not disrupting the regular visual appearance of the door.

Preferably, both transmission members extend horizontally outwards from both surfaces of the door. With this arrangement, the noise generated as successive sections of the door enter and engage with the guide channels is dampened since each transmission member is positioned between the door and the respective guide channel thereby preventing the door from coming into direct contact with the upper and lower guide channels during movement.

The door used in the elevator door system should be suitable for being wound upon and unwound from a vertical axis. Accordingly, it should have a form which is rigid in the vertical direction. The door can be formed from a single sheet of material which is rigid or reinforced in the vertical direction as disclosed in WO-A2-2005/070807.

Alternatively, the door can be formed from a plurality of vertically aligned rigid panels. Each panel may be interconnected to its neighbor as disclosed in WO-A2-2005/070808. On the other hand, the panels may be secured individually to the or each transmission member, which arrangement would greatly simplify, for example, the replacement of defective panels and ensures that the lateral driving force developed by the motor is not transmitted through the door panel.

The force transmission member can be interconnected to the vertical axis via an end panel of the door. Alternatively, the force transmission member can be directly connected to the vertical axis.

The door can be formed from a plurality of glass panels mounted on an interlayer supported between the first transmission member and the second transmission member. The present invention is particularly advantageous for this purpose since glass panels are particularly brittle and are liable to fracture if neighboring layers come into contact as the door is wound upon the reel. Furthermore, the door can be transparent which is an important aesthetic consideration, particularly when the door is incorporated in a panoramic elevator. Alternatively, the glass panels and/or the interlayer may be colored or have a specific pattern allowing specific information or advertisements to be displayed to the passengers.

Preferably the first transmission member, the second transmission member and the interlayer are integrally manufactured. A suitable material for this integral manufacturing is polyvinylbutyral (PVB).

Preferably, a separation means is disposed between the door and the flexible force transmission member to separate the door from the transmission member to enable substantially friction-free relative rotation therebetween.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
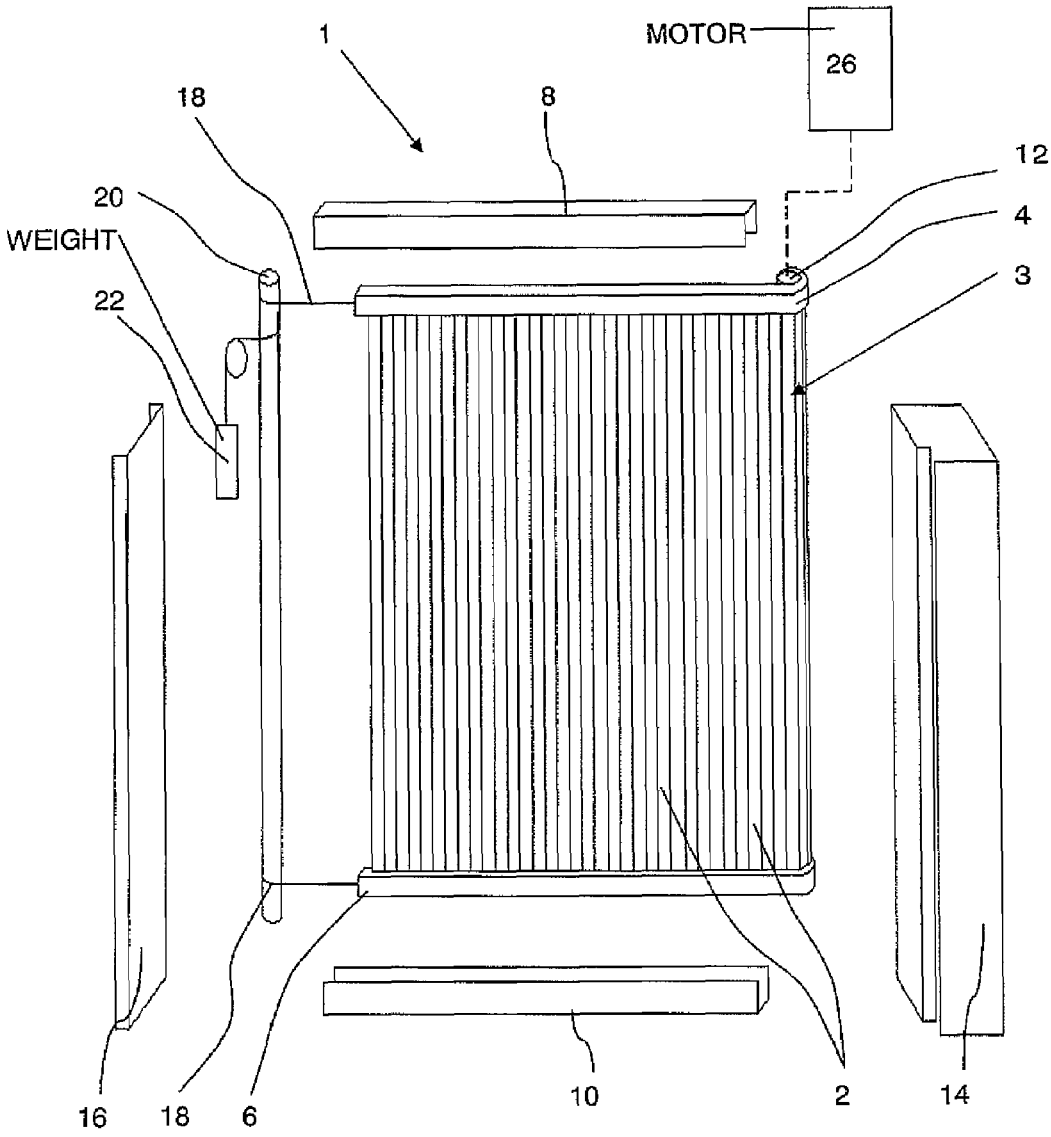
FIG. 1 is an exploded perspective view an elevator car door system according to the present invention.

FIG. 1 is a general exploded perspective view of an elevator door system 1 incorporating a car door 3 according to a first embodiment of the present invention which is used to control access to an elevator car (not shown) from a landing within a building. The door 3 is composed of a plurality of vertically aligned panels 2 each of which is preferably extruded from aluminium for its superior strength to weight ratio. The panels 2 are bound at their extremities by an upper belt of plastic material 4 and a lower belt of plastic material 6, respectively. The belts 4, 6 are attached at one end to a reel 12, rotation of which is controlled by a motor 26 to open and close the door 3. The opposing ends of the belts 4, 6 are attached by cables 18 to a counter-reel 20 which is biased in a door closing direction by a closing weight 22. The reel 12 and the counter-reel 20 are contained and retained within opposing door jambs 14 and 16, respectively.

During operation, the belts 4, 6 are guided along an upper guide channel 8 and a lower guide channel 10, respectively to permit or prevent access through the doorway defined by the side jambs 14, 16 and the upper and lower guide channels 8, 10. In the fully closed position, the panel 2 which forms the leading edge of the door 3 engages with the side jamb 16. In the fully opened position, the belts 4, 6 and the panels 2 are drawn into the opposing side jamb 14 and wound onto the reel 12.

If power to the motor 26 is interrupted during operation, the gravitational force acting on the closing weight 22 transmits a force through the counter-reel 20 and the cables 18 which is sufficient to overcome the inertia of both the motor 26 and the door 3 to automatically close the door 3, thereby ensuring the safety of any passengers.

Figure 2:
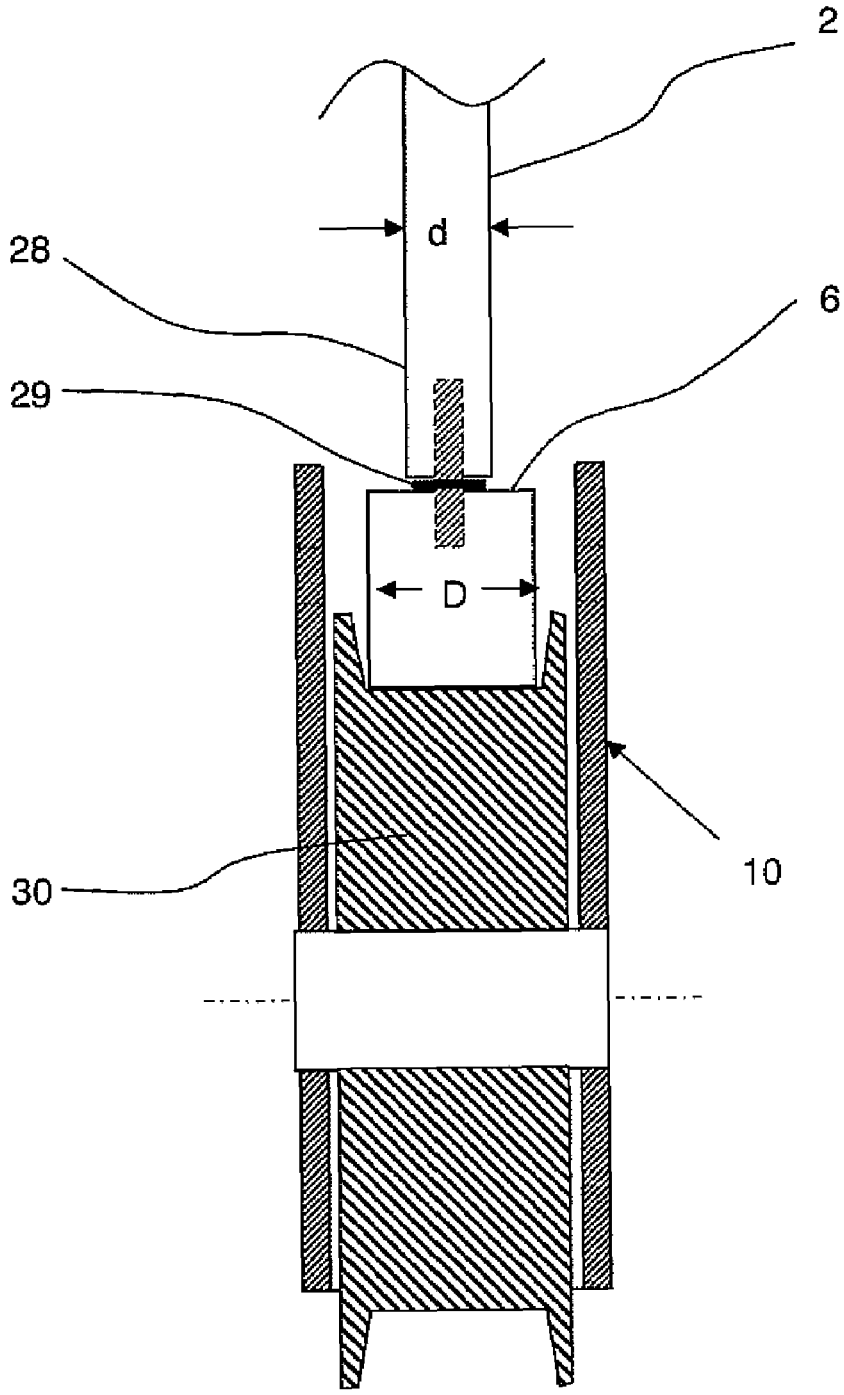
FIG. 2 is an enlarged cross-section of the lower section of door of FIG. 1.

FIG. 2 is a cross-section of the lower section of the door 3 of FIG. 1 which emphasizes the guidance of the lower belt 6 and thereby the panels 2 during opening and closing of the door 3. It will be readily appreciated that the guidance of the upper belt 4 is achieved in the same manner. The panels 2 are mounted on the lower belt 6 by pins 28. A separation means such as a washer 29 surrounds each pin 28 to separate the panel 2 from the belt 6 thereby enabling substantially friction-free relative rotation therebetween.

If each of the panels 2 is interconnected directly with its neighbor, then only a single mounting pin 28 is required per panel 2. However, if the panels 2 are not interconnected, as in the present embodiment, two or more of the pins 28 are required to keep each panel 2 secured to the lower belt 6. This arrangement has a further advantage in that an individual panel 2 can easily be removed without disturbing the neighboring panels 2.

As shown specifically in FIG. 2, a depth "d" of the panels 2 is significantly less than a depth "D" of the lower belt 6. Hence, during an opening operation as the door 3 is wound in layers onto the reel 12, the belts 4, 6 effectively prevent panels 2 from one layer of the door 3 coming into contact with those in the neighboring layers.

Pulleys 30 are mounted at regular intervals along the lower guide channel 10 to rotatably engage with the lower belt 6 during operation as it moves along the guide channel 10.

Instead of having the belts 4, 6 attached directly to the reel 12, they can be interconnected to the reel 12 via the lagging-end panel 2 of the door 3.

Figure 3:
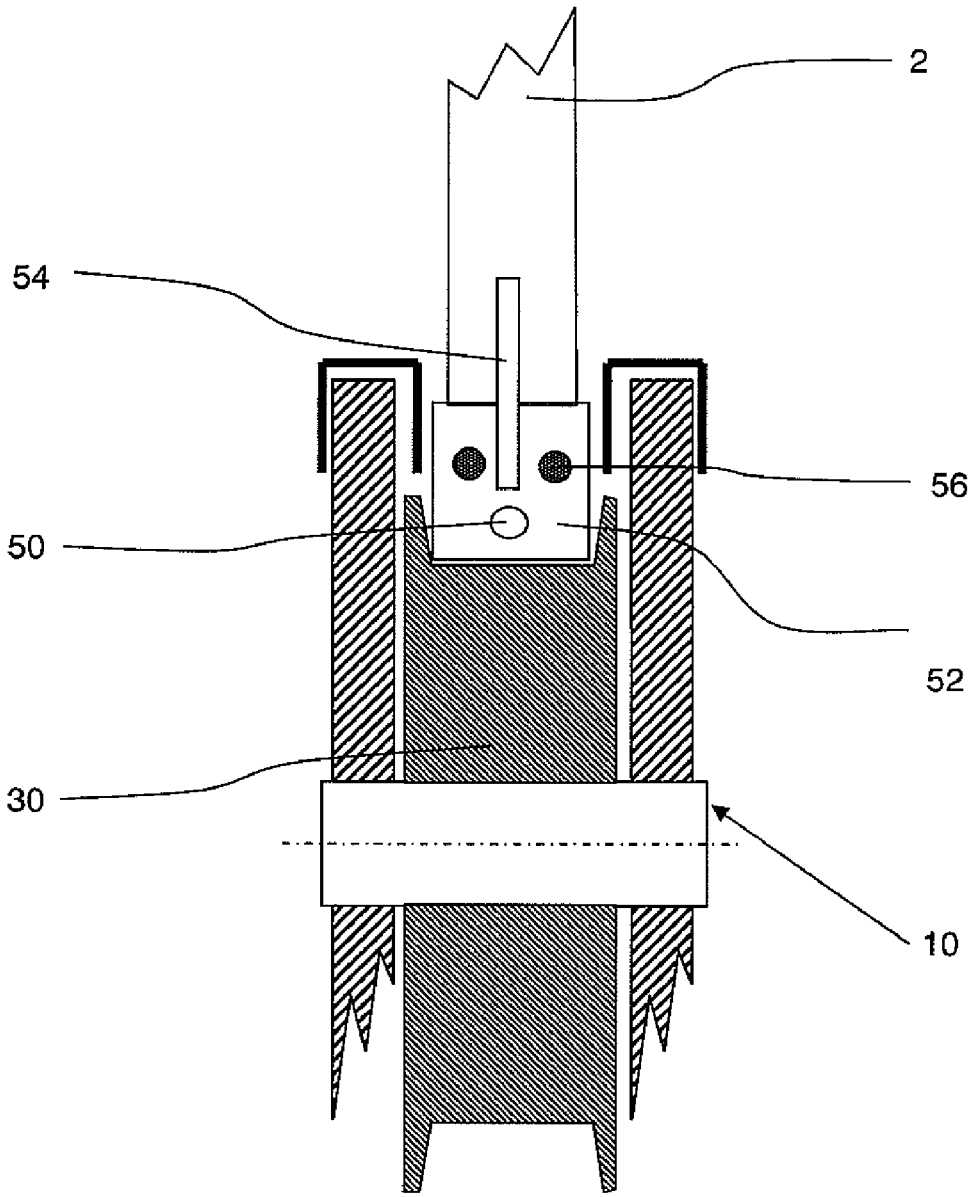
FIG. 3 is a cross-section of the lower section of a door according to a second embodiment of the present invention.

FIG. 3 shows an alternative embodiment to that illustrated in FIG. 2 in which each individual panel 2 forming the door 3 is secured to an upper and a lower guidance shoe 52 by plate-like inserts 54. The guidance shoe 52 spans substantially the same width as the panel 2 to which it is secured. The belt 6 of the previous embodiment is replaced by a much smaller force transmission cord 50 embedded in each of the guidance shoes 52. Additionally, the guidance shoes 52 can be used to carry conductors or wires 56 to any safety device, such as a light curtain, that maybe installed on the leading edge of the door 3. It will be readily appreciated that the arrangement of the upper guidance shoes (not shown) corresponds to that just described for the lower guidance shoes 52.

Figure 4:
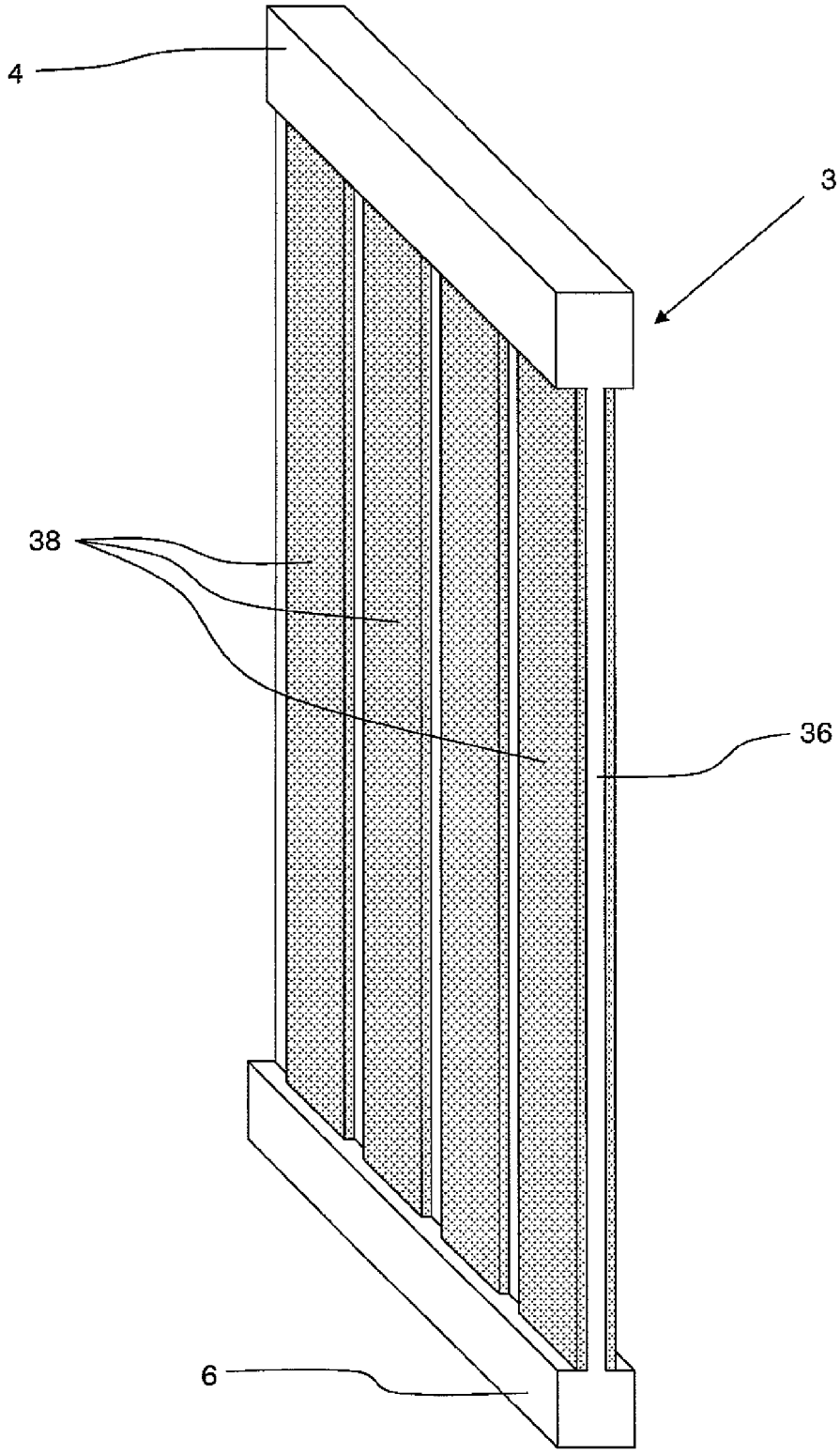
FIG. 4 is partial perspective view of a door of an elevator door system according to a third embodiment of the present invention.

FIG. 4 is partial perspective view of an elevator door according to a third embodiment of the present invention wherein the constituent panels 2 of the door 3 of the previous embodiments are replaced by pairs of glass panels 38 embedded in, affixed or bonded to either side of a plasticized interlayer 36 of polyvinylbutyral (PVB) material. The interlayer 36 is suspended between the upper belt 4 and the lower belt 6 respectively. Preferably, the upper and lower belts 4, 6 are manufactured integrally from the same PVB material as the interlayer 36.

Figure 5:
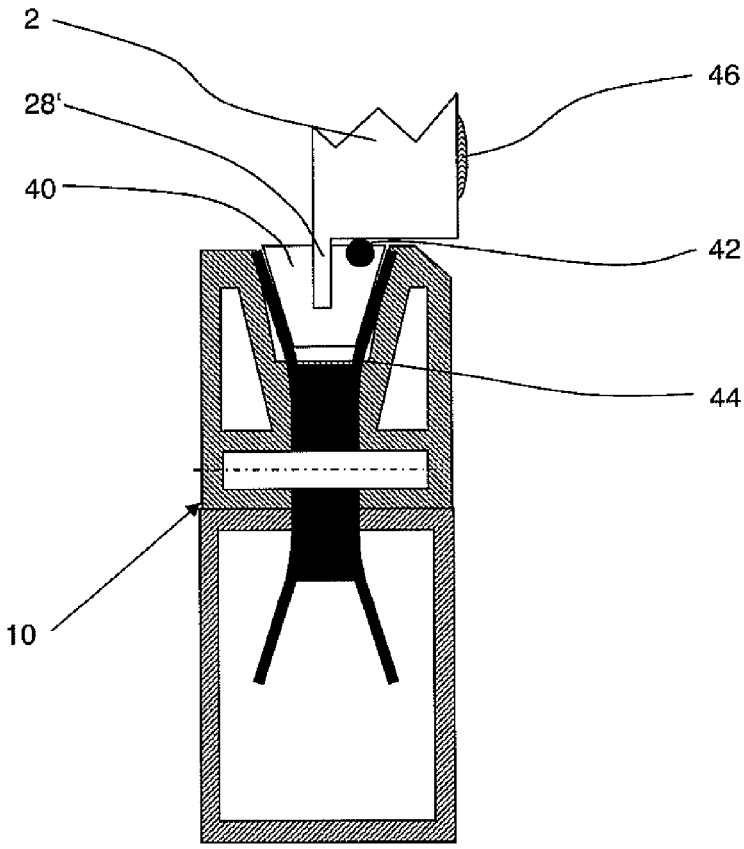
FIG. 5 is a cross-section of a lower section of a door of an elevator door system according to a fourth embodiment of the present invention.
Figure 6:
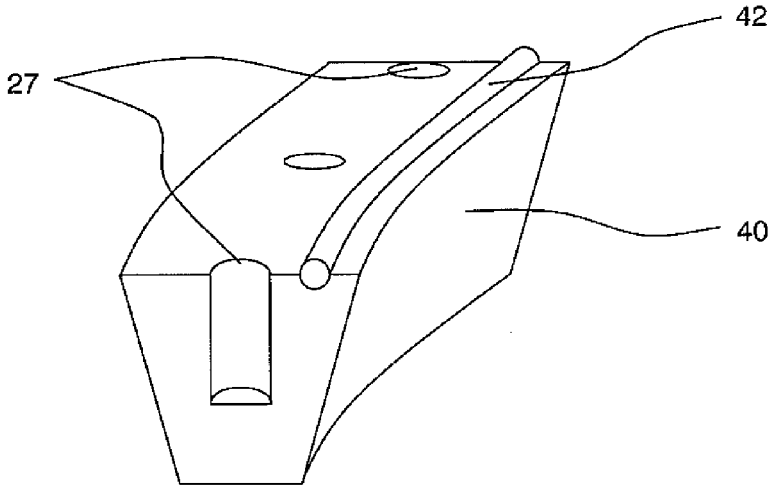
FIG. 6 is a partial perspective view of the lower belt of FIG. 5.

FIG. 5 and FIG. 6 illustrate components of an elevator door system according to a fourth embodiment of the present invention. Although the drawings and the following description refer only to the lower guide channel 10 and a lower transmission belt 40, it will be readily appreciated that the guidance at the upper section of the door 3 is achieved in the same manner.

As in the previously described embodiments, one end of the belt 40 is secured to the reel 12 and the other end is connected by the cable 18 to the counter-reel 20 as shown in the general arrangement of FIG. 1. Rather than the rectangular profile of the previous embodiments, the lower belt 40 used in this embodiment has a cropped V-shape. During operation, the belt 40 is guided by pulleys 44 rotatably mounted in the lower guide channel 10 and having converging flanges which engage with the side walls of the V-belt 40 to provide the necessary horizontal and vertical guidance.

Each of the door panels 2 is provided with one or more integral pins 28' that are inserted into and received by mounting holes 27 provided in the belt 40. A wire 42 is partially embedded in the belt 40 along its entire width. The embedded wire 42 replaced the washers 29 of the embodiment illustrated in FIG. 2 as separation means whereby the exposed portion of the wire 42 separates the panel 2 from the belt 40 to enable substantially friction-free relative rotation therebetween. In contrast to the previous embodiments, the depth of the V-belt 40 is considerably less than the depth of the door panels 2. In this instance, one or more bumpers or bands 46 are secured to the surface of the door panels 2 so that during an opening operation as the door 3 is wound in layers onto the reel 12, the bumpers or bands 46 effectively prevent the panels 2 from one layer of the door 3 coming into contact with those in the neighboring layers.

In the previously described embodiments of the present invention, the door 3 is formed from a plurality of rigid panels (the metallic panels 2 illustrated in FIGS. 1 to 3 and FIG. 5 or the glass panels 38 of FIG. 4). However, it is equally possible to implement the invention using a single sheet of material having sufficient vertical rigidity so that it is self-standing under its own weight.

Although in the preferred embodiments the pulleys 30, 44 are mounted on the guide channels 8, 10 to ensure a smooth guidance of the door 3 during movement, it will be readily appreciated that other guidance arrangements (for example a sliding system) are equally applicable.

It will be understood that the counter-reel 20, instead of being biased by the closing weight 22, could alternatively be spring biased to develop a force sufficient to overcome the inertia of the motor 26 and the door 3 so as to automatically close the door 3 if, for example, the power to the motor 26 is disrupted.

In an alternative arrangement, deflection pulleys can be used in place of the counter-reel 20 to deflect the cable 18 for interconnection to the motorized reel 12 so that the motor 26 as well as developing a thrust on the belts 4, 6 simultaneously exerts a drag on the belts 4, 6.

Since the belts 4, 6 are equally capable of transmitting compressive force as well as tensile force, the door system according to the present invention operates effectively without the pre-tensioning of the closing weight 22, a spring bias or a closed-loop interconnection to the motorized reel 12.

Due to its inherent flexibility PVB is the preferred material for the interlayer 36 in laminating the glass panels 38. However, a resinous interlayer is also feasible so long as the cured resin laminate has a sufficient degree of flexibility to enable the resultant door to be wound onto the reel.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator door system comprising:

a motor;

a vertical reel rotatably driven by said motor;

a door wound upon and unwound from said reel by operation of said motor;

a flexible force transmission member mounted on and extending along an entire width of said door, said flexible force transmission member being directly connected to said reel whereupon said flexible force transmission member selectively transmits tensile and compressive forces generated by said motor to said door; and a vertical counter-reel rotatably mounted, a weight attached to said counter-reel and said flexible force transmission member being attached to said counter-reel with a cable, said weight operating to rotate said counter-reel and unwind said door from said reel when said motor is not generating said tensile and compressive force, wherein said vertical reel and said vertical counter-reel are spaced apart and non-coaxial.

2. The elevator door system according to claim 1 including a first one of said flexible force transmission member being provided at an upper edge of said door and a second one of said flexible force transmission member being provided at a lower edge of said door.

3. The elevator door system according to claim 1 wherein said elevator door is formed from a sheet of material which is rigid or reinforced in a vertical direction.

4. The elevator door system according to claim 1 wherein said elevator door is formed from a plurality of vertically aligned rigid panels.

* * * * *